US011060226B2

(12) United States Patent
Kim et al.

(10) Patent No.: US 11,060,226 B2
(45) Date of Patent: Jul. 13, 2021

(54) LAUNDRY TREATING APPARATUS HAVING INDUCTION HEATER AND CONTROL METHOD THEREOF

(71) Applicant: LG Electronics Inc., Seoul (KR)

(72) Inventors: Woore Kim, Seoul (KR); Beomjun Kim, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 1 day.

(21) Appl. No.: 16/738,665

(22) Filed: Jan. 9, 2020

(65) Prior Publication Data

US 2020/0224350 A1 Jul. 16, 2020

(30) Foreign Application Priority Data

Jan. 10, 2019 (KR) ..... 10-2019-0003547

(51) Int. Cl.
*D06F 33/70* (2020.01)
*D06F 58/46* (2020.01)
(Continued)

(52) U.S. Cl.
CPC ..... *D06F 33/70* (2020.02); *D06F 34/24* (2020.02); *D06F 39/04* (2013.01); *D06F 58/26* (2013.01); *D06F 58/46* (2020.02)

(58) Field of Classification Search
CPC ..... D06F 33/70; D06F 39/04; D06F 34/24; D06F 58/46; D06F 58/26
(Continued)

(56) References Cited

U.S. PATENT DOCUMENTS 5,724,750 A * 3/1998 Burress ..... D06F 58/02 34/267
7,647,794 B2 1/2010 Park et al.
(Continued)

FOREIGN PATENT DOCUMENTS

DE 102016110859 6/2017
DE 102016110883 11/2017
(Continued)

OTHER PUBLICATIONS

Extended European Search Report in European Application No. 20150857.9, dated May 12, 2020, 8 pages.
(Continued)

*Primary Examiner* — Stephen M Gravini
(74) *Attorney, Agent, or Firm* — Fish & Richardson P.C.

(57) ABSTRACT

An object treating apparatus includes a tub, a rotatable drum for receiving an object, an induction heater for heating an outer circumferential face of the drum, a motor for rotating the drum, an upper temperature sensor, a lower temperature sensor, and a processor. The upper temperature sensor detects a temperature of a space between the tub and the drum. The upper temperature sensor is disposed inside the tube at an upper portion of the tub. The lower temperature sensor detects a temperature around condensed water at a bottom of the tub. The lower temperature sensor is disposed inside the tub at a lower portion of the tub. The processor can determine a drying ending timing based on the temperatures detected by the upper and lower temperature sensors.

25 Claims, 8 Drawing Sheets

(51) Int. Cl.
*D06F 34/24* (2020.01)
*D06F 39/04* (2006.01)
*D06F 58/26* (2006.01)

(58) Field of Classification Search
USPC ..... 34/486, 595–610
See application file for complete search history.

(56) References Cited

U.S. PATENT DOCUMENTS

| | | | | |
|---|---|---|---|---|
| 7,762,007 | B2 * | 7/2010 | Guinibert | D06F 37/302 34/601 |
| 8,732,979 | B2 * | 5/2014 | Ashrafzadeh | D06F 58/20 34/601 |
| 10,563,343 | B2 * | 2/2020 | Chung | D06F 58/30 |
| 10,626,543 | B2 * | 4/2020 | Lim | D06F 58/26 |
| 10,704,189 | B2 * | 7/2020 | Christensen | D06F 25/00 |
| 2013/0152422 | A1 | 6/2013 | Chen et al. | |
| 2018/0100263 | A1 | 4/2018 | Yao et al. | |
| 2018/0148886 | A1 | 5/2018 | Kalze et al. | |
| 2018/0298544 | A1 * | 10/2018 | O'Rourke | D06F 25/00 |
| 2019/0338455 | A1 * | 11/2019 | Garnek | D06F 37/266 |
| 2020/0048813 | A1 * | 2/2020 | Schaumann | D06F 39/045 |
| 2020/0115838 | A1 * | 4/2020 | Kim | D06F 37/304 |
| 2020/0173094 | A1 * | 6/2020 | Kim | D06F 34/28 |
| 2020/0181830 | A1 * | 6/2020 | Jang | D06F 29/005 |
| 2020/0190726 | A1 * | 6/2020 | Jang | D06F 37/36 |
| 2020/0217007 | A1 * | 7/2020 | Kim | D06F 33/63 |
| 2020/0224350 | A1 * | 7/2020 | Kim | D06F 58/46 |
| 2020/0224351 | A1 * | 7/2020 | Jang | D06F 39/04 |
| 2020/0407903 | A1 * | 12/2020 | Han | D06F 34/06 |
| 2021/0010185 | A1 * | 1/2021 | Bueno | D06F 33/48 |
| 2021/0047165 | A1 * | 2/2021 | Showalter | B67D 1/0406 |

FOREIGN PATENT DOCUMENTS

| | | | | |
|---|---|---|---|---|
| EP | 1497490 | B1 * | 8/2012 | D06F 39/125 |
| EP | 2032757 | | 7/2016 | |
| EP | 3564429 | A1 * | 11/2019 | D06F 39/024 |
| EP | 3660196 | A1 * | 6/2020 | D06F 34/28 |
| EP | 3680381 | A1 * | 7/2020 | D06F 58/46 |
| KR | 1020040100555 | | 12/2004 | |
| KR | 100811487 | | 3/2008 | |
| KR | 10-1024920 | | 3/2011 | |
| KR | 10-2019-0016860 | | 2/2019 | |
| WO | WO-03087459 | A1 * | 10/2003 | D06F 58/04 |
| WO | WO2018038580 | | 3/2018 | |
| WO | WO-2020145632 | A1 * | 7/2020 | D06F 58/46 |

OTHER PUBLICATIONS

PCT International Search Report and Written Opinion in International Application No. PCT/KR2020/000281, dated May 6, 2020, 13 pages.

* cited by examiner

LAUNDRY TREATING APPARATUS HAVING INDUCTION HEATER AND CONTROL METHOD THEREOF

CROSS-REFERENCE TO RELATED APPLICATION

This application claims the benefit of Korean Patent Application No. 10-2019-0003547, filed on Jan. 10, 2019, which is hereby incorporated by reference as when fully set forth herein.

BACKGROUND

Field

The present disclosure relates to a laundry treating apparatus, and more particularly, to a laundry treating apparatus for heating a drum using an induction heater and a control method thereof.

Discussion of the Related Art

A laundry washing apparatus includes a tub (outer tub) for storing washing-water and a drum (inner tub) disposed rotatably in the tub. Laundry is contained inside the drum. As the drum rotates, the laundry is washed using detergent and washing-water.

In order to enhance the washing effect by promoting activation of detergents and decomposition of contaminants, hot washing-water is fed into the tub or heated inside the tub. To this end, generally, an inner bottom of the tub is recessed downward to form a heater mount, and a heater is mounted into the heater mount. Such a heater is generally a sheath heater.

The laundry treating apparatus may include a drying and washing machine which may perform washing and drying, and a dryer which may perform only drying.

In general, the drying may be performed by supplying hot air into the drum to heat an object to evaporate moisture away therefrom. The dryer may include an exhaust type dryer for discharging humid air to an outside of the laundry treating apparatus and a circulation type dryer for condensing moisture from the humid air and supplying dry air back to the drum.

The drying refers to a process of heating the object to remove moisture therefrom. Thus, it is very important to determine exactly when the drying ends. That is, it is very important to stop the heating of the object and stop drying when a moisture content of the object reaches a predefined moisture content. This may prevent insufficient drying or excessive drying.

In many cases, a humidity sensor may be used to detect dryness or humidity. That is, moisture content or humidity of the object is detected by using a sensor such as an electrode rod exposed inside the drum. Therefore, the drying is terminated when an appropriate humidity is detected by the humidity sensor.

However, the humidity sensor may be suitable for a dryer that performs drying using hot-air supply. This is because the humidity sensor may be contaminated by detergent, washing-water or lint in the drying and washing machine where washing may be performed. Such contamination makes it difficult to sense accurate humidity. Therefore, it is common that the humidity sensor is applied to the dryer which only perform the drying.

Further, in a prior art, in the drying and washing machine with a condensing duct and a drying duct as a portion of a circulation duct where hot-air is circulated, temperature sensors are respectively installed near an inlet of the condensing duct (where air from the tub enters the condensing duct), and near an outlet of the condensing duct (where air is discharged from the condensing duct to the drying duct. Thus, a drying end time point is determined based on temperatures of the sensors. In one example, dryness may be determined based on a difference between a temperature of condensed water and temperature of air after condensation. The dryness may be indirectly determined based on a fact that at a last time point of the drying process, water condensation is very small and thus the temperature of condensed water is lowered close to a temperature of cooling water (water at room temperature).

However, this dryness detection scheme requires air circulating, and a separate circulation duct (including a condensation duct in which condensation is performed and a drying duct in which air is heated). In addition, it is not easy to manufacture an apparatus using this dryness detection scheme because the two temperature sensors must be respectively installed at front and rear ends of the condensing duct. In particular, because a temperature sensor for detecting a temperature of washing-water is required separately in this scheme, there is a problem that three or more temperature sensors are required for the detection of the temperature of the washing-water and dryness of the object.

Some laundry treating apparatuses may heat and dry an object by directly heating a drum using an induction heater. Further, some laundry treating apparatuses operate to supply cooling water to an inner circumferential face of the tub to condense moisture in humid air inside the tub.

Some laundry treating apparatuses may be free of a circulating duct and may be configured to perform both of washing and drying. Therefore, there is a need to find a scheme to detect the dryness or humidity and thus detect an end time point of drying effectively based on the detection result in this type of the laundry treating apparatus.

SUMMARY

A purpose of the present disclosure is basically to solve the problem of the conventional laundry treating apparatus as mentioned above.

According to one embodiment of the present disclosure, a purpose of the present disclosure is to provide a laundry treating apparatus which may effectively identify a drying ending timing in the laundry treating apparatus in which a circulating duct is not disposed, and provide a control method thereof.

According to one embodiment of the present disclosure, a purpose of the present disclosure is to provide a laundry treating apparatus in which a possibility at which a sensor for detecting dryness may malfunction or detect the dryness inaccurately due to detergents, washing-water, condensed water, cooling water or lint may be significantly reduced, and provide a control method thereof.

According to one embodiment of the present disclosure, a purpose of the present disclosure is to provide a laundry treating apparatus which may detect dryness using a washing-water temperature sensor disposed in a conventional laundry treating apparatus and provide a control method thereof. That is, according to one embodiment of the present disclosure, a purpose of the present disclosure is to provide a laundry treating apparatus in which a single temperature sensor may be used for various purposes according to cycles performed by the laundry treating apparatus, and provide a control method thereof.

According to one embodiment of the present disclosure, a purpose of the present disclosure is to provide a laundry treating apparatus in which cooling water and condensed water do not come into contact with a washing-water temperature sensor during drying to minimize temperature variation caused by cooling water, thereby to determine accurate dryness, and provide a control method thereof.

According to one embodiment of the present disclosure, a purpose of the present disclosure is to provide a laundry treating apparatus which may detect dryness using a drying temperature sensor configured to prevent overheating of an induction heater, and provide a control method thereof. That is, according to one embodiment of the present disclosure, a purpose of the present disclosure is to provide a laundry treating apparatus which may use a single temperature sensor for a plurality of purposes, and provide a control method thereof.

According to one embodiment of the present disclosure, a purpose of the present disclosure is to provide a laundry treating apparatus which may effectively determine a drying ending timing without directly contacting a drying target with a sensor, and provide a control method thereof.

According to one embodiment of the present disclosure, a purpose of the present disclosure is to provide a laundry treating apparatus which effectively determines a drying target load amount and a drying ending timing using one or two temperature sensors, and provide a control method thereof. In particular, according to one embodiment of the present disclosure, a purpose of the present disclosure is to provide a laundry treating apparatus which effectively determines a drying target load amount and a drying ending timing based on a change of a temperature around condensed water condensed by natural convection during drying, and provide a control method thereof.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

Particular embodiments described herein include an object treating apparatus including a tub, a drum, an induction heater, a motor, a first temperature sensor, a second temperature sensor, and a processor. The tub has a first tub portion and a second tub portion, and the second tub portion may be arranged vertically below the first tub portion. The drum may be rotatably disposed within the tub and configured to receive an object therein. The induction heater may be disposed on the tub and configured to heat an outer circumferential face of the drum facing the heater. The motor may be configured to rotate the drum. The first temperature sensor may be configured to detect a temperature of a space between the tub and the drum. The first temperature sensor may be disposed inside the tub at the first tub portion. The second temperature sensor may be configured to detect a temperature of condensed water at a bottom of the tub. The second temperature sensor may be disposed in the second tub portion and inside the tub. The processor may be configured to control a rotation of the drum and further control the induction heater to heat the drum so that the object is dried in the drum. The processor may be configured to determine a drying time of the object based on a difference between a first temperature detected by the first temperature sensor and a second temperature detected by the second temperature sensor.

In some implementations, the system can optionally include one or more of the following features. The induction heater may be placed on a top of the outer circumferential face of the tub. The first temperature sensor may be located adjacent to the induction heater. The first temperature sensor may be positioned outside a region in which the induction heater vertically faces toward the drum. The first temperature sensor may be located at a first side of the first tub portion. The tub may have a communication hole defined in at a second side of the first tub portion. The second side may be opposite to the first side. The communication hole may be configured to fluidly communicate an inside of the tub with an outside of the tub. The object treating apparatus may include a cooling water port provided at a rear face of the tub to supply cooling water to an inner wall of the tub. The cooling water port may be configured to supply the cooling water to cause the cooling water to flow along a first inner circumferential face of the tub or flow along a second inner circumferential face of the tub, or flow along the first inner circumferential face and the second inner circumferential face of the tub. The second inner circumferential face may be opposite to the first circumferential face. Based on the first temperature sensor detecting a predefined temperature, the processor may be configured to stop the induction heater or to lower an output thereof. A distance between the first temperature sensor and a front end of the tub may be smaller than a distance between the second temperature sensor and the front end of the tub. The tub may have a condensed water receiving portion having a recess in the bottom of the tub. The condensed water may be contained in the condensed water receiving portion. The second temperature sensor may be spaced away from a bottom surface of the condensed water receiving portion. The second temperature sensor may pass through a rear wall of the tub. The second temperature sensor may be spaced at a distance from the bottom surface of the condensed water receiving portion, and the distance may range between 10 mm and 15 mm. Based on the second temperature sensor detecting that a washing-water temperature reaches a predefined temperature while the inductor heater heats the washing-water to perform a washing cycle, the processor may be configured to stop the induction heater or to lower an output of the induction heater. The processor may be configured to finish the drying of the object based on the difference satisfying a threshold value, the threshold value being greater as a drying target load amount is larger. The processor may be configured to determine the drying target load amount based on a time at which the difference between the first temperature detected by the first temperature sensor and the second temperature detected by the second temperature sensor is smallest for an initial drying duration. The processor may be configured to determine the drying target load amount based on the difference being the smallest for an initial drying duration. A time at which the drying target load amount is determined may occur after a heating target temperature of the drum is detected by the first temperature sensor. Each of the first temperature sensor and the second temperature sensor may include a thermistor configured to allow active control of the processor. Steam evaporated in heat exchange between the heated drum and the object may be condensed into the condensed water inside the tub and flow to the bottom of the tub.

Particular embodiments described herein include an object treating apparatus including a tub, a drum, an induction heater, a motor, a first temperature sensor, a second temperature sensor, and a processor. The tub has a first tub portion and a second tub portion, and the second tub portion may be arranged vertically below the first tub portion. The drum may be rotatably disposed within the tub and configured to receive an object therein. The induction heater may be disposed on the tub and configured to heat an outer circumferential face of the drum facing the heater. The motor may be configured to rotate the drum. The first temperature sensor may be configured to detect a temperature of a space between the tub and the drum. The first temperature sensor may be disposed inside the tub at the first tub portion. The second temperature sensor may be configured to detect a temperature of condensed water at a bottom of the tub. The second temperature sensor may be disposed in the second tub portion and inside the tub. The processor may be configured to control a rotation of the drum and further control the induction heater to heat the drum so that the object is dried in the drum. The processor may be configured to determine a drying time of the object based on the first temperature sensor detecting a heating target temperature of the drum. The processor may be configured to determine the drying time based on a difference between a highest temperature detected by the second temperature sensor and a temperature subsequently detected by the second temperature sensor. Steam evaporated in heat exchange between the heated drum and the object may be condensed into the condensed water inside the tub and flow to the bottom of the tub.

Particular embodiments described herein include a method for controlling a laundry treating apparatus to dry an object. The apparatus may include a tub, a drum rotatably disposed within the tub and configured to receive the object therein, and an induction heater disposed on the tub and configured to heat an outer circumferential face of the drum facing the heater. The method may include detecting a temperature around a space between the tub and the drum using a first temperature sensor disposed at a first tub portion of the tub and inside the tub; controlling the induction heater based on the detected temperature; condensing steam evaporated in heat exchange between the heated drum and the object into condensed water inside the tub, wherein the condensed water flows to a bottom of the tub; detecting a temperature around the condensed water stored on the bottom of the tub using a second temperature sensor, wherein the second temperature sensor is disposed at a second tub portion of the tub and inside the tub, the second tub portion arranged lower than the first tub portion; determining a drying ending timing based on a difference between a first temperature detected by the first temperature sensor and a second temperature detected by the second temperature sensor, or a difference between a highest temperature detected by the second temperature sensor and a temperature subsequently detected by the second temperature sensor; and terminating the drying based on the determined drying ending timing.

In some implementations, the system can optionally include one or more of the following features. Detecting a temperature around the space between the tub and the drum and controlling the induction heater may be performed in parallel with condensing steam and detecting a temperature around the condensed water.

One aspect of the present disclosure provides an object treating apparatus comprising: a tub; a drum rotatably disposed within the tub and accommodating an object therein; an induction heater disposed on the tub and configured to heat an outer circumferential face of the drum contacting the heater; a motor to rotate the drum; and an upper temperature sensor (drying temperature sensor) configured to detect a temperature around a space between the tub and the drum, wherein the upper temperature sensor is disposed at an upper portion of the tub and inside the tub; a lower temperature sensor (washing-water/condensed water temperature sensor) configured to detect a temperature around condensed water stored on a bottom of the tub, wherein the lower temperature sensor is disposed at a lower portion of the tub and inside the tub, wherein humid steam evaporated in heat exchange between the heated drum and the object is condensed into the condensed water inside the tub and the condensed water flows to the bottom of the tub; and a processor configured to control a rotation of the drum and an operation of the induction heater to heat the drum to heat and dry the object. Another aspect of the present disclosure provides a method for controlling the object treating apparatus.

In one implementation, the processor may determine a drying ending timing based on the temperatures detected by the upper and lower temperature sensors. More specifically, the processor is configured to determine an ending timing of the drying of the object based on a difference (delta T) between a temperature detected by the upper temperature sensor and a temperature detected by the lower temperature sensor.

Such a difference in the temperature may be due to a fact that a heat exchange between the humid steam and the cooling water due to natural convection in the tub occurs, and the condensed water flows downward.

In one implementation, the induction heater is placed on a top and outer circumferential face of the tub, wherein the upper temperature sensor is located adjacent to the induction heater.

In one implementation, the upper temperature sensor is positioned outside a projection region in which the induction heater vertically projects toward the drum. That is, the upper temperature sensor senses the temperature as close to a heating source as possible. However, it is desirable to install the upper temperature sensor in a position such that the upper temperature sensor may avoid influence of a magnetic field from the induction heater.

In one implementation, the upper temperature sensor is located at a right side of the upper portion of the tub when the tub is viewed from a front thereof. In one implementation, the tub has a communication hole defined in at a left side of the upper portion of the tub when the tub is viewed from a front thereof, wherein the communication hole communicates between an inside and an outside of the tub. Therefore, the influence of the communication hole may be minimized.

In one implementation, the object treating apparatus includes a cooling water port disposed on a rear face of the tub to supply cooling water to an inner wall of the tub.

In one implementation, when the tub is viewed from a front thereof, the cooling water port is constructed to supply the cooling water such that the cooling water flows along a right inner circumferential face of the tub and/or flow along a left inner circumferential face of the tub. Therefore, the cooling water may be thinly and evenly spread on the inner circumferential face of the tub to maximize a heat exchange area between the cooling water and humid air.

In one implementation, when the upper temperature sensor detects a predefined temperature, the processor is configured to control to stop the operation of the induction heater or to lower an output thereof. That is, the upper temperature sensor may be basically configured such that the induction heater performs heating up of the drum to the heating target temperature and repeats heating to maintain the heating target temperature of the drum.

In one implementation, a spacing between the upper temperature sensor and a front end of the tub is smaller than a spacing between the lower temperature sensor and the front end of the tub. That is, the upper temperature sensor may be located closer to the heating source.

In one implementation, the tub has a condensed water receiving portion having a recess defined downwards in a bottom of the tub, wherein the condensed water is contained in the condensed water receiving portion.

In one implementation, the lower temperature sensor is spaced upwardly from a bottom face of the condensed water receiving portion. The lower temperature sensor may detect air temperature around the condensed water instead of directly sensing the temperature of the condensed water. That is, the lower temperature sensor may be configured to sense the air temperature, not the water temperature, when drying, and to sense the water temperature when washing.

In one implementation, the lower temperature sensor passes through a rear wall of the tub. For this reason, the condensed water receiving portion may be formed at a rear portion of the tub. The tub may be constructed in an inclined form from a front to a back and thus may have a tilting type.

In one implementation, the lower temperature sensor is spaced, by a spacing of 10 mm to 15 mm, preferably, 12 mm, from the bottom face of the condensed water receiving portion. This allows the lower temperature sensor to be mounted close to the condensed water without being in contact with the condensed water during drying.

In one implementation, when the lower temperature sensor detects that a washing-water temperature reaches a predefined temperature while the inductor heater heats the washing-water to perform a washing cycle, the processor is configured to stop the operation of the induction heater or to lower an output of the induction heater.

That is, the lower temperature sensor may basically be used such that the apparatus controls the target heating temperature of the washing-water during washing. The induction heater is operated until the washing-water is heated up such that the temperature thereof reaches the target heating temperature. Thereafter, an on/off control of the induction heater may be repeated to maintain the target heating temperature.

Therefore, in the present embodiment, the upper temperature sensor and the lower temperature sensor may have additional functions used to determine the drying ending timing in addition to main functions thereof.

In one implementation, as a drying target load amount is larger, the temperature difference for determining the drying ending timing is larger. Therefore, once the drying target load amount is determined, the apparatus predefines the temperature or delta T that is used to determine the drying ending timing. During drying, the drying target load amount is determined. The drying termination factor is determined based on the determined drying target load amount. The drying ends when the drying termination factor is satisfied during the drying.

In one implementation, the processor is configured to determine the drying target load amount based on a time point at which the difference (delta T) between the temperature detected by the upper temperature sensor and the temperature detected by the lower temperature sensor is smallest for an initial drying duration. This may correspond to a case that the larger the drying target load amount is, a time point at which the smallest delta T is detected is late.

In one implementation, the processor is configured to determine the drying target load amount based on a smallest difference (delta T) between the temperature detected by the upper temperature sensor and the temperature detected by the lower temperature sensor for an initial drying duration. This may correspond to a case that the larger the drying target load amount is, the larger the delta T at a time when the smallest delta T is detected.

An initial drying duration may be defined as a duration from the start of drying to a time when the delta T is the greatest before the upper temperature sensor detects the heating target temperature. An intermediate drying duration may be defined as a duration from an end of the initial drying duration to a time when the delta T is smallest. Finally, a last drying duration may be defined as a duration from an end of the intermediate drying duration to a time when the heating stops depending on the temperature detected by the lower temperature sensor or the delta T.

In one implementation, a time point at which the drying target load amount is determined occurs after a heating target temperature of the drum is detected by the upper temperature sensor.

In one implementation, each of the upper temperature sensor and the lower temperature sensor includes a thermistor configured to allow active control of the processor.

Another aspect of the present disclosure provides an object treating apparatus comprising: a tub; a drum rotatably disposed within the tub and accommodating an object therein; an induction heater disposed on the tub and configured to heat an outer circumferential face of the drum contacting the heater; a motor to rotate the drum; and an upper temperature sensor (drying temperature sensor) configured to detect a temperature around a space between the tub and the drum, wherein the upper temperature sensor is disposed at an upper portion of the tub and inside the tub; a lower temperature sensor (washing-water/condensed water temperature sensor) configured to detect a temperature around condensed water stored on a bottom of the tub, wherein the lower temperature sensor is disposed at a lower portion of the tub and inside the tub, wherein humid steam evaporated in heat exchange between the heated drum and the object is condensed into the condensed water inside the tub and the condensed water flows to the bottom of the tub; and a processor configured to control a rotation of the drum and an operation of the induction heater to heat the drum to heat and dry the object, wherein the processor is configured to determine an ending timing of the drying of the object after the upper temperature sensor detects a heating target temperature of the drum, wherein the processor is configured to determine the ending timing of the drying of the object based on a difference (delta T) between a highest temperature detected by the lower temperature sensor and a temperature subsequently detected by the lower temperature sensor.

Still another aspect of the present disclosure provides a method for controlling a laundry treating apparatus to dry an object, wherein the apparatus includes a tub, a drum rotatably disposed within the tub and accommodating the object therein, and an induction heater disposed on the tub and configured to heat an outer circumferential face of the drum contacting the heater, the method comprising: a heating step including: detecting a temperature around a space between the tub and the drum using an upper temperature sensor disposed at an upper portion of the tub and inside the tub; and controlling an operation of the induction heater based on the detected temperature; a condensing step including condensing humid steam evaporated in heat exchange between the heated drum and the object into condensed water inside the tub which flows to the bottom of the tub; and detecting a temperature around the condensed water stored on a bottom of the tub using a lower temperature sensor, wherein the lower temperature sensor is disposed at a lower portion of the tub and inside the tub; and a drying termination step including: determining a drying ending timing based on a difference between a temperature detected by the upper temperature sensor and a temperature detected by the lower temperature sensor, or a difference between a highest temperature detected by the lower temperature sensor and a temperature subsequently detected by the lower temperature sensor; and terminating the drying based on the determined drying ending timing.

In one implementation, during the drying, the heating step and the condensing step is carried out in parallel.

The features of the above-described implantations may be combined with other embodiments as long as they are not contradictory or exclusive to each other.

Effects of the present disclosure are as follows but are limited thereto:

According to one embodiment of the present disclosure, the present disclosure may provide a laundry treating apparatus which may effectively identify a drying ending timing in the laundry treating apparatus in which a circulating duct is not disposed, and provide a control method thereof.

According to one embodiment of the present disclosure, the present disclosure may provide a laundry treating apparatus in which a possibility at which a sensor for detecting dryness may malfunction or detect the dryness inaccurately due to detergents, washing-water, condensed water, cooling water or lint may be significantly reduced, and provide a control method thereof.

According to one embodiment of the present disclosure, the present disclosure may provide a laundry treating apparatus which may detect dryness using a washing-water temperature sensor disposed in a conventional laundry treating apparatus and provide a control method thereof. That is, according to one embodiment of the present disclosure, the present disclosure may provide a laundry treating apparatus in which a single temperature sensor may be used for various purposes according to cycles performed by the laundry treating apparatus, and provide a control method thereof.

According to one embodiment of the present disclosure, the present disclosure may provide a laundry treating apparatus in which cooling water and condensed water do not come into contact with a washing-water temperature sensor during drying to minimize temperature variation caused by cooling water, thereby to determine accurate dryness, and provide a control method thereof.

According to one embodiment of the present disclosure, the present disclosure may provide a laundry treating apparatus which may detect dryness using a drying temperature sensor configured to prevent overheating of an induction heater, and provide a control method thereof. That is, according to one embodiment of the present disclosure, the present disclosure may provide a laundry treating apparatus which may use a single temperature sensor for a plurality of purposes, and provide a control method thereof.

According to one embodiment of the present disclosure, the present disclosure may provide a laundry treating apparatus which may effectively determine a drying ending timing without directly contacting a drying target with a sensor, and provide a control method thereof.

According to one embodiment of the present disclosure, the present disclosure may provide a laundry treating apparatus which effectively determines a drying target load amount and a drying ending timing using one or two temperature sensors, and provide a control method thereof. In particular, according to one embodiment of the present disclosure, the present disclosure may provide a laundry treating apparatus which effectively determines a drying target load amount and a drying ending timing based on a change of a temperature around condensed water condensed by natural convection during drying, and provide a control method thereof.

Effects of the present disclosure are not limited to the above effects. Those skilled in the art may readily derive various effects of the present disclosure from various configurations of the present disclosure.

DETAILED DESCRIPTIONS

Figure 1:
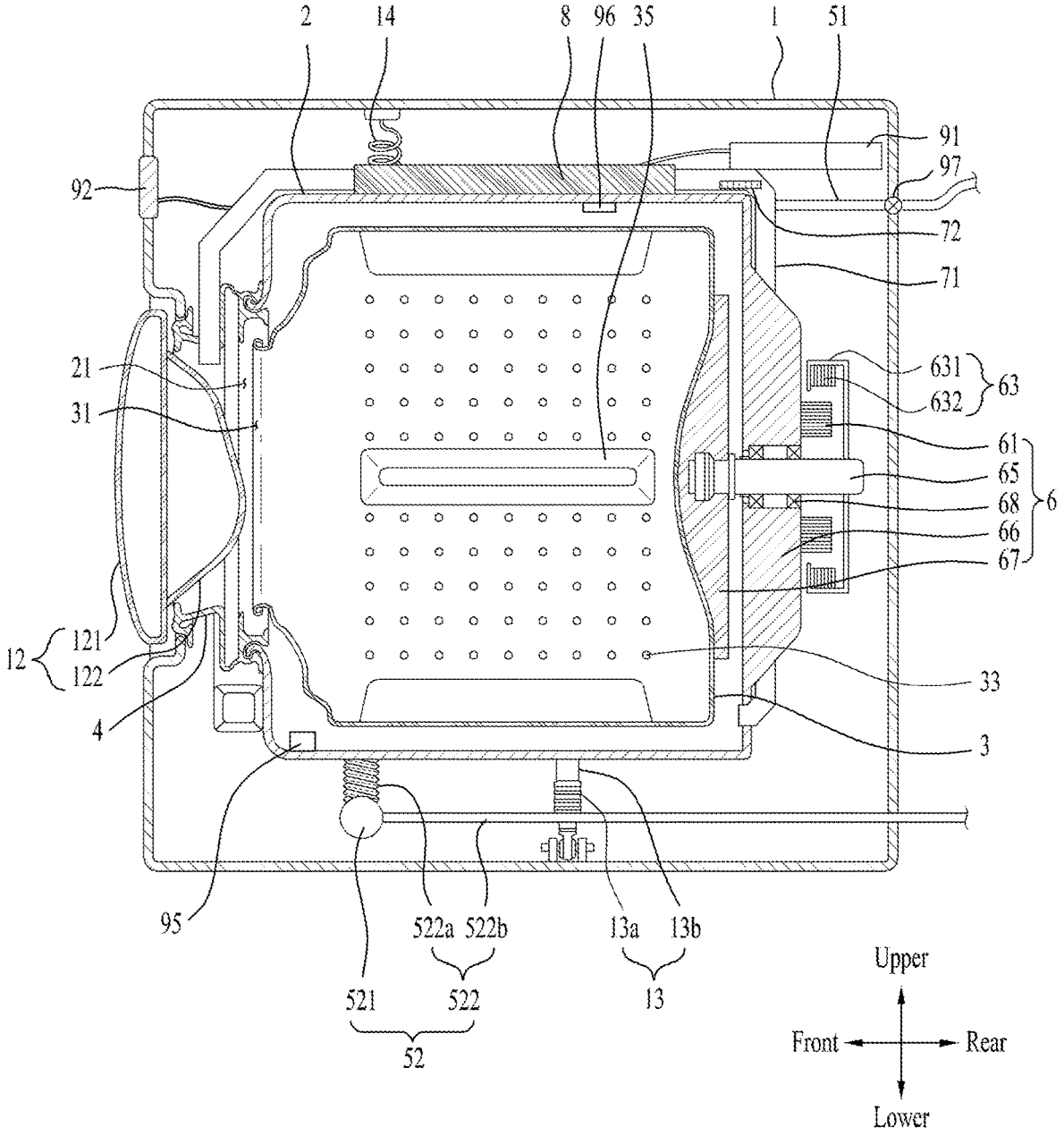
FIG. 1 shows a cross section of a laundry treating apparatus according to one embodiment of the present disclosure.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, with reference to FIG. 1, a laundry treating apparatus according to one embodiment of the present disclosure will be described.

The laundry treating apparatus according to one embodiment of the present disclosure includes a cabinet 1 forming an appearance, a tub 2 disposed inside the cabinet, and a drum 3 rotatably disposed inside the tub 2 and containing an object (in one example, washing target, drying target, or refreshing target). In one example, when washing the laundry using washing-water, the object may be referred to as a washing target. When wet laundry is dried using heat, the object may be referred to as a drying target. When dry laundry is refreshed using hot-air, cold wind or steam, the object may be referred to as a refreshing target. Therefore, the washing, drying or refreshing of the laundry may be performed using the drum 3 of the laundry treating apparatus.

The cabinet 1 may have a cabinet opening defined in a front face of the cabinet 1. The object may enter and exit the drum through the cabinet opening. The cabinet 1 may be equipped with a door 12 pivotally mounted to the cabinet to open and close the opening.

The door 12 may be composed of an annular door frame 121 and a transparent glass 122 disposed in a center of the door frame.

In this connection, when defining a direction to help understand the detailed structure of the laundry treating apparatus to be described below, a direction from a center of the cabinet 1 towards the door 12 may be defined as a front direction.

Further, an opposite direction to the front direction towards the door 12 may be defined as a rear direction. A right direction and a left direction may naturally be defined depending on the front and rear directions as defined above.

The tub 2 is cylindrically shaped with a longitudinal axis thereof being parallel to a bottom face of the cabinet or maintained to be tilted at 0 to 30° relative to the bottom face. The tub 2 has an inner space in which water may be stored. A tub opening 21 is defined in a front face of the tub to communicate with the cabinet opening.

The tub 2 may be secured to the bottom face of the cabinet via a lower support 13 including a support bar 13*a* and a damper 13*b* connected to the support bar 13*a*. Accordingly, vibration generated from the tub 2 may be attenuated by rotation of the drum 3.

Further, a top face of the tub 2 may be connected to an elastic support 14 fixed to a top face of the cabinet 1. This configuration may act to dampen the vibration generated in the tub 2 and then transmitted to the cabinet 1.

The drum 3 has a cylindrical shape whose longitudinal axis is parallel to the bottom face of the cabinet or is tilted at 0 to 30° relative to the bottom face. The drum contains the object. A front face of the drum 3 may have a drum opening 31 defined therein in communication with the tub opening 21. An angle between a center axis of the tub 2 and the bottom face of the cabinet may be equal to an angle between a center axis of the drum 3 and the bottom face.

Further, the drum 3 may include multiple through-holes 33 penetrating the outer circumferential face thereof. The washing-water and air may communicate between the inside of the drum 3 and the inside of tub 2 using the through-holes 33.

A lifter 35 for stirring the object when the drum rotates may be disposed on the inner circumferential face of the drum 3. The drum 3 may be rotated by a driver 6 placed behind the tub 2.

The driver 6 may include a stator 61 fixed to a back fade of the tub 2, a rotor 63 that rotates via electromagnetic action with the stator 61, and a rotation shaft 65 passing through the back face of the tub 2 and connecting the drum 3 and rotor 63 with each other.

The stator 61 may be fixed to a rear face of a bearing housing 66 disposed on the back face of the tub 2. The rotor 63 may include a rotor magnet 632 disposed radially outwardly of the stator, and a rotor housing 631 connecting the rotor magnet 632 and the rotation shaft 65 with each other.

The bearing housing 66 may contain a plurality of bearings 68 which support the rotation shaft 65. Further, a spider 67 to easily transfer the rotational force of the rotor 63 to the drum 3 may be disposed on the rear face of the drum 3. The rotation shaft 65 may be fixed to the spider 67 and may transmit a rotational power of the rotor 63.

In one example, the laundry treating apparatus according to an embodiment of the present disclosure may further include a water supply hose 51 supplied with water from the outside. The water hose 51 forms a water supply channel to the tub 2.

Further, a gasket 4 may be provided between the opening of the cabinet 1 and the tub opening 21. The gasket 4 prevents leakage of water inside the tub 2 into the cabinet 1 and prevents transmission of vibration from the tub 2 into the cabinet 1.

In one example, the laundry treating apparatus according to an embodiment of the present disclosure may further include a water discharger 52 for discharging water inside the tub 2 to the outside of the cabinet 1.

The water discharger 52 may include a water discharge pipe 522 which forms a drainage channel along which the water inside the tub 2 flows, and a water discharge pump 521 which generates a pressure difference inside the water discharge pipe 522 such that the water is drained through the water discharge pipe 522.

More specifically, the water discharge pipe 522 may include a first water discharge pipe 522*a* connecting a bottom face of the tub 2 and the water discharge pump 521 to each other, and a second water discharge pipe 522*b* having one end connected to the water discharge pump 521 to form a channel through which water flows out of the cabinet 1.

Further, the laundry treating apparatus according to an embodiment of the present disclosure may further include a heater 8 for induction-heating the drum 3.

The heater 8 is mounted on a circumferential face of the tub 2. The heater may execute induction heating of a circumferential face of the drum 3 using a magnetic field generated when applying current to a coil as a wire winding. Thus, the heater may be referred to as an induction heater. When the induction type heater is operated, the outer circumferential face of the drum facing the induction heater 8 may be heated to very high temperatures in a very short time.

The heater 8 may be controlled by a controller 9 fixed to the cabinet 1. The controller 9 controls a temperature inside the tub by controlling the operation of the heater 8. The controller 9 may include a processor for controlling an operation of the laundry treating apparatus. The controller may include an inverter processor that controls the heater. That is, the operation of the laundry treating apparatus and the operation of the heater 8 may be controlled using one processor.

However, in order to improve control efficiency and prevent overloading of the processor, a general processor controlling the operation of the laundry treating apparatus and a special purpose processor controlling the heater may be separately provided and may be communicatively connected to each other.

A temperature sensor 95 may be placed inside the tub 2. The temperature sensor 95 may be connected to the controller 9 and communicate an internal temperature information of the tub 2 to the controller 9. In particular, the temperature sensor 95 may be configured to sense a temperature of washing-water or humid air. Therefore, this sensor 95 may be referred to as a washing-water temperature sensor.

The temperature sensor 95 may be placed near an inner bottom face of the tub. Thus, the temperature sensor 95 may be located at a lower level than a level of a bottom of the drum. FIG. 1 shows that the temperature sensor 95 is configured to contact the bottom of the tub. However, it is desirable that the sensor 95 is spaced, by a predetermined distance, away from the bottom face of the tub. This spacing allows the washing-water or air to surround the temperature sensor so that the washing-water or air temperature may be accurately measured. In addition, the temperature sensor 95 may be mounted so as to penetrate the tub from a bottom of the tub to a top thereof. In another example, the sensor 95 may be mounted so as to penetrate the tub from a front face of the tub to a rear face thereof. That is, the sensor 95 may be mounted to pass through a front face (the face having the tub opening defined therein) rather than a circumferential face of the tub.

Thus, when the laundry treating apparatus heats the washing-water using the induction heater 8, the temperature sensor may detect whether the washing-water is heated up to a target temperature. The operation of the induction heater may be controlled based on the detection result of the temperature sensor.

Further, when the washing-water is completely drained, the temperature sensor 95 may detect the air temperature. Because remaining washing-water or cooling water remains on the bottom of the tub, the temperature sensor 95 senses a temperature of humid air.

In one example, the laundry treating apparatus according to an embodiment of the present disclosure may include a drying temperature sensor 96. The drying temperature sensor 96 may differ from the above-described temperature sensor 95 in terms of an installation position and a temperature measurement target. The drying temperature sensor 96 may detect a temperature of the air heated using the induction heater 8, that is, a drying temperature. Therefore, whether or not the air is heated to the target temperature may be detected using the temperature sensor. The operation of the induction heater may be controlled based on the detection result of the drying temperature sensor.

The drying temperature sensor 96 may be located on a top of the tub 2 and placed adjacent to the induction heater 8. That is, the sensor 96 may be disposed on the inner face of tub 2 while the induction heater 8 is disposed on an outer face of the tub 2. The sensor 96 may be configured to detect a temperature of an outer circumferential face of the drum 3. The above-described temperature sensor 95 may be configured to detect the temperature of the surrounding water or air. The drying temperature sensor 96 may be configured to detect the temperature of the drum or a drying air temperature around the drum.

Because the drum 3 is rotatable, the drying temperature sensor 96 may detect a temperature of air near the outer circumferential face of the drum 30 to indirectly detect the temperature of the outer circumferential face of the drum.

The temperature sensor 95 may be configured to determine whether to continue the operation of the induction heater until the target temperature is achieved or to determine whether to vary an output of the induction heater. The drying temperature sensor 96 may be configured to determine whether the drum is overheated. Upon determining that the drum is overheated, a controller may forcibly terminate the operation of the induction heater.

In addition, the laundry treating apparatus according to an embodiment of the present disclosure may have a drying function. In this case, the laundry treating apparatus according to one embodiment of the present disclosure may be referred to as a drying and washing machine. For this purpose, the apparatus may further include a fan 72 for blowing air into the tub 2, and a duct 71 having the fan 72 mounted therein. In another example, the apparatus may perform the drying function even when those components are not additionally present. That is, the air may be cooled and the water may be condensed on the inner circumferential face of the tub and then may be discharged. In other words, drying may be carried out by the condensation of the water itself even without air circulation. Cooling water may be supplied into the tub to improve the water condensation and improve the drying efficiency. The larger a contact surface area where the cooling water and the tub contact each other, that is, a contact surface area where the cooling water and the air contact with each other, better the drying efficiency. To this end, the cooling water may be supplied as the cooling water spreads widely across the back face of the tub or one side face or both side faces of the tub. This cooling water supply scheme may allow the cooling water to flow along the inner surface of the tub to prevent the cooling water from entering the drum. Therefore, the component such as the duct or fan may be omitted for the drying, thereby making it very easy to manufacture the apparatus.

In this connection, there is no need to provide a separate heater for drying. That is, the drying may be performed using the induction heater 8. That is, all of washing-water heating at washing, object heating at dehydration, and object heating at drying may be performed using a single induction heater.

When the drum 3 operates and the induction heater 8 operates, an entire outer circumferential face of the drum may heat up. The heated drum exchange heat with wet laundry and heats the laundry. In another example, air inside the drum may be heated. Therefore, when the air is supplied to the inside of the drum 3, the air has evaporated away moisture from the laundry via heat exchange and then the cooled air may be discharged to the outside of the drum 3. That is, air may circulate between the duct 71 and drum 3. In another example, the fan 72 will be operated for air circulation.

A position into which air is supplied and a position from which air is discharged may be determined so that the heated air may be evenly supplied to the drying target and humid air may be smoothly discharged. For this purpose, air may be supplied onto a front and top position of the drum 3, while the air may be discharged from a rear and bottom position of the drum 3, that is, a rear and bottom position of the tub.

After the air is discharged from a rear and bottom position of the drum 3, that is, a rear and bottom position of the tub, the air flows along the duct 71. In the duct 71, moisture in humid air may condense due to condensate water supplied into the duct 71 through a condensate water channel 51. When the moisture in humid air condenses, the air is converted to cold dry air. This cold dry air may flow along the duct 71 and be fed back into the drum 3.

Thus, because this system does not directly heat the air itself, a temperature of the heated air may be lower than a temperature of air heated using a typical heater type dryer. Therefore, effect of preventing damage or deformation of the laundry due to a high temperature may be expected. In another example, the laundry may be overheated while the laundry contacts the drum heated to a high temperature.

As described above, however, as the drum is operated, the induction heater is operated. The laundry is repeatedly moved up and down as the drum is operated. A lower portion of the drum is not heated but an upper portion of the drum is heated. Thus, this approach may effectively prevent the laundry from being overheated.

A control panel 92 may be disposed on a front or top face of the laundry treating apparatus. The control panel may act as a user interface. A user may input various inputs onto the control panel. Various information may be displayed on the control panel. That is, a manipulator for user manipulation and a display for displaying information to the user may be disposed on the control panel 92.

Figure 2:
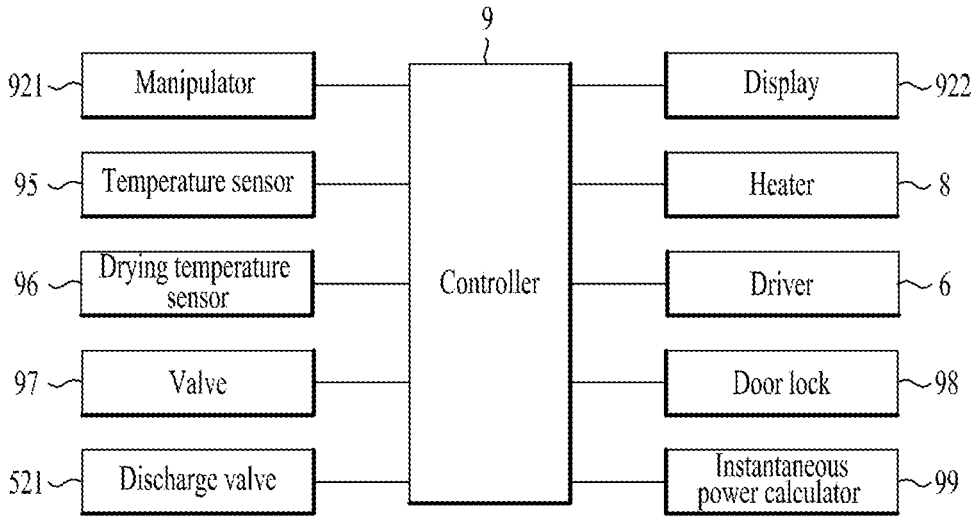
FIG. 2 shows a block diagram of a control configuration of a laundry treating apparatus according to one embodiment of the present disclosure.

FIG. 2 shows a systematic block diagram of a laundry treating apparatus according to one embodiment of the present disclosure.

The controller 9 may control an operation of the induction heater 8 based on detection results of the temperature sensor 95, and the drying temperature sensor 96. The controller 9 may control an operation of a driver 6 which drives the drum using a motor and control operations of various sensors and hardware. The controller 9 may control various valves and pumps for water supply, drainage, and cooling water supply, and may control the fan.

In particular, according to the present embodiment, the apparatus may include a cooling water valve 97 for converting a high temperature and high humidity air/environment to a low temperature dry air/environment. The cooling water valve 97 may allow cold water to be fed into the tub or into the duct to cool air therein to condense moisture in the air.

During dehydration and/or cooling water supply, the discharge pump 421 may be operated periodically or intermittently.

According to this embodiment, the apparatus may include a door lock 98. The door lock may refer to as a door locking device to prevent a door from being opened during operation of the laundry treating apparatus. According to this embodiment, the door opening may be prohibited when an internal temperature is higher than a preset temperature not only during an operation of the laundry treating apparatus but also after an operation of the laundry treating apparatus is completed.

Further, the controller 9 may control various displays 922 disposed on the control panel 92. Further, the controller 9 may receive signals from various manipulators 921 disposed on the control panel 92 and may control all operations of the laundry treating apparatus based on the signals.

In one example, the controller 9 may include a main processor that controls a general operation of the laundry treating apparatus and an auxiliary processor that controls an operation of the induction heater. The main processor and the auxiliary processor may be separately disposed and may be communicatively connected to each other.

According to one embodiment of the present disclosure, the controller may vary an output of the induction heater. The controller may increase the output of the induction heater as much as possible within an acceptable condition or range, thereby to reduce a heating time such that a maximum effect may be obtained. To this end, in this embodiment, an instantaneous power calculator 99 may be included in the apparatus. Details thereof will be described later.

Hereinafter, with reference to FIG. 3, a principle of varying an output of the induction heater that may be applied to one embodiment of the present disclosure will be described in detail. The instantaneous power calculator 99 may be used to vary the output of the induction heater. The laundry treating apparatus may have a predefined maximum allowable power. That is, the laundry treating apparatus may be configured such that an instantaneous maximum power thereof is below a predetermined power value. This value is indicated in FIG. 3 as a system allowable power.

Hardware using the greatest power in the laundry treating apparatus according to the present embodiment may be a motor, that is, the driver 6 that operates the induction heater 8 and the drum.

Figure 3:
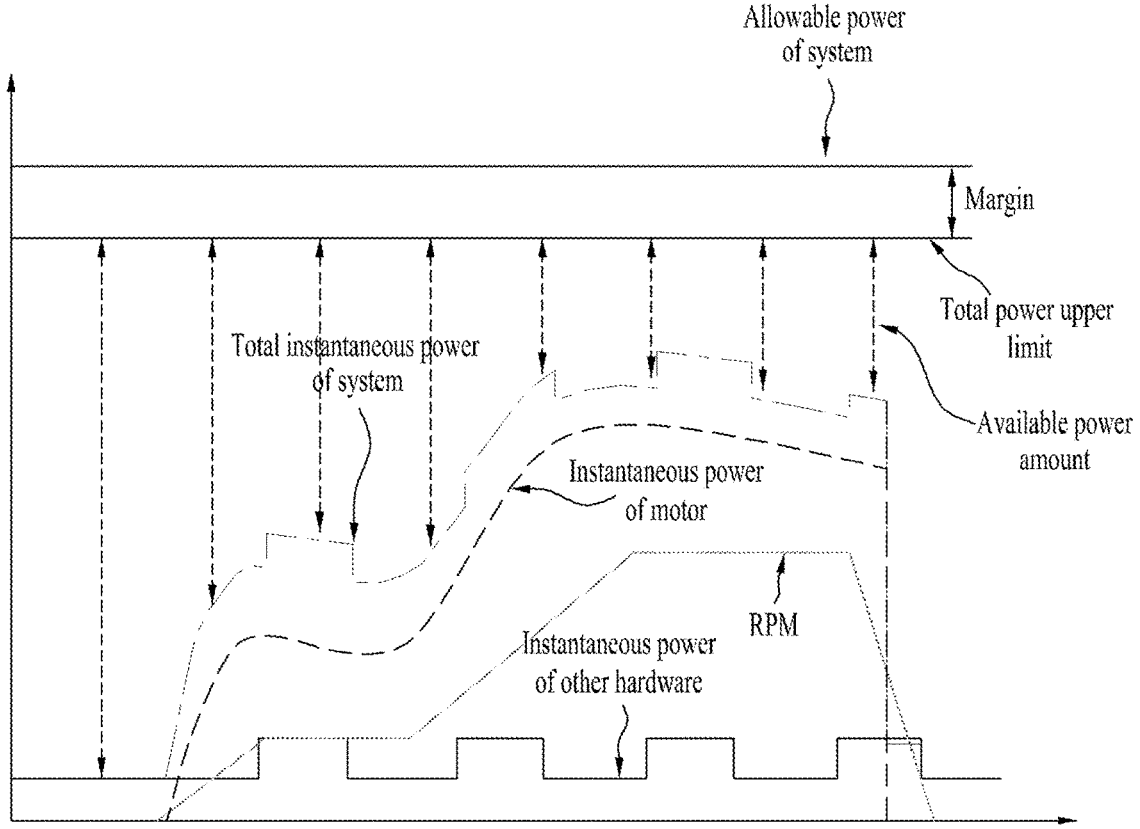
FIG. 3 is a graph illustrating a principle of varying an output of an induction heater in a laundry treating apparatus according to one embodiment of the present disclosure.

As shown in FIG. 3, a power used by the driver, that is, an instantaneous power used by the driver, tends to increase as the RPM increases. Further, the instantaneous power used by the driver tends to increase as laundry eccentricity increases. As the power used by the driver increases, an instantaneous power of an entire system also tends to increase. In other words, it may be seen that most of the instantaneous power of the entire system is used by the driver.

During heating dehydration or drying, power is consumed from the control panel 92, the various valves 97, the water discharge pump 521 and the various sensors 95 and 96 as well as the induction heater 8 and the driver 6. Therefore, as shown in FIG. 3, when the allowable power value is determined in the laundry treating apparatus system, a total power upper limit that may be used maximally in the laundry treating apparatus may be pre-defined in consideration of a margin.

In a conventional laundry treating apparatus, a power of the sheath heater during heating dehydration is pre-defined. That is, the power of the sheath heater is pre-defined to be smaller than the total power upper limit minus a maximum power value excluding a power of the sheath heater during heating dehydration.

For example, when the allowable power value of the laundry treating apparatus system is 100 and the margin is 10, the total power upper limit may be 90. When the maximum power value excluding a power of the sheath heater during heating dehydration is 70, the power of the sheath heater may be to be smaller than 20. In this connection, the maximum power excluding the power of the sheath heater may a sum of powers of hardware components except for the sheath heater at a maximum RPM and at a maximum laundry eccentricity (severe environment).

An output varying degree of the sheath heater itself is very limited. When using the sheath heater, there is a problem in that the heater may not be used at a maximum degree in a general environment rather than the extreme environment.

In order to solve this problem, in the present embodiment, the apparatus may include the instantaneous power calculator 99. That is, the instantaneous power calculator may calculate an instantaneous power or may calculate and output the instantaneous power. This instantaneous power calculator 99 may be disposed separately from the controller 9. Alternatively. a portion of the instantaneous power calculator 99 may be disposed separately from the controller 9 or may be included in the controller.

As described above, in the heating dehydration and drying, the hardware component which uses the greatest power except the induction heater 8 may be the motor, that is, the driver 6. A maximum power of each of other hardware components than the induction heater and driver during the heating dehydration and drying may be predefined. The maximum power of each of the other hardware components will be relatively small.

Thus, the instantaneous power calculator 99 may be configured to estimate or calculate the instantaneous power of the motor operating the drum.

In one example, the instantaneous power calculator 99 may calculate the instantaneous power of the motor based on an input current and a DC link voltage input to the motor.

In one example, the instantaneous power calculator 99 may calculate the instantaneous power of the motor based on an input current and an input voltage input to the motor.

In one example, the instantaneous power calculator 99 may calculate the instantaneous power of the motor based on an input current input to the motor and an AC input voltage applied to the laundry treating apparatus.

Therefore, the instantaneous power calculator 99 includes a device, element or circuit for detecting the current and voltage and may be configured to output the calculated instantaneous power of the motor.

When the instantaneous power of the motor is calculated, a possible power of the induction heater 8 may be calculated. In other words, the total power upper limit minus the calculated instantaneous power of the motor and the calculated maximal powers of the other hardware components may be the possible power of the induction heater.

In this connection, the instantaneous power of the motor may vary considerably. This is because a RPM varying range and a laundry eccentricity may be large. Therefore, the power of the motor may be preferably calculated as the instantaneous power, that is, the current power. To the contrary, the maximum power of each of the other hardware components is relatively small and a varying range thereof is small and thus may be pre-defined as a maximum value and may be a fixed value. In another example, the maximum power of each of the other hardware components may be calculated as an instantaneous power thereof. However, because the power value of each of the other hardware components is relatively small, it may be desirable to set the power value to a fixed value and thus exclude addition of a device or circuit for separate power measurement and calculation.

In one example, the instantaneous power calculator 99 may be configured to estimate or calculate a total instantaneous power of the laundry treating apparatus. In one example, the total instantaneous power of the laundry treating apparatus may be calculated based on an AC input current and an AC input voltage applied to the laundry treating apparatus. The total instantaneous power during heating dehydration may be a sum of the powers of the induction heater, motor, and other hardware components. Thus, a difference between the total instantaneous power and the total power upper limit may mean an additional power that may increase the output of the induction heater. In one example, when the total instantaneous power is 50 and the total power upper limit is 90, the power of the induction heater may be increased by 40.

Thus, according to this embodiment, a maximum output of the induction heater may be secured at a current possible power state of the system. In other words, when the motor uses the considerable power, this may reduce the output of the heater. To the contrary, when the motor consumes a small current amount, this may increase the output of the heater.

When controlling an output of the induction heater using the instantaneous power calculator 99, the apparatus may control the induction heater safely while the heating time may be reduced. Assuming that a total amount of heat required for the drying and heating dehydration is constant, shortening of the heating time means that a loss amount of heat toward an outside may be reduced. Thus, energy consumption may be reduced. Further, the apparatus may reduce drying and heating dehydration time durations. Therefore, user convenience may be enhanced.

As described above, the laundry treating apparatus according to the present embodiment may perform both heating for washing and heating for drying using the induction heater 8. That is, the laundry treating apparatus that may perform drying as well as washing may be provided.

When the drum is rotated while heating the drum accommodating therein a wet object, heat transfer between the drum and the object is performed when the drum and the object contact each other. Thus, the object heats up, thereby allowing moisture to evaporate from the object.

In this embodiment, a separate circulating duct for generating a forced flow of air for drying may not be required. In other words, moisture evaporation occurs in the tub inner-space and moisture condensing may occur therein.

Because the drum is directly heated by the induction heater, the drum temperature is relatively high. Further, because heat is transferred from the drum to the object, the temperature inside the drum is higher than a temperature outside the drum, that is, a temperature of a space between the drum and the tub. Therefore, when examining an entire space inside the tub and a heat transfer path, a temperature of an inner wall or inner surface of the tub is the lowest.

Due to this characteristic of the substantially closed tub inner-space, natural convection occurs in the tub inner-space. Moisture condensing occurs when humid air that contains moisture moves vertically or horizontally and contacts an inner surface of the tub. Condensed water generated by the moisture condensing moves along an inner face of the tube to a bottom of the tub. Air from which moisture has been removed descends and flows back into the drum, where the air encounters evaporated water vapor and thus may be heated again. Using this natural convection, moisture may be effectively removed from the object and thus drying may be performed.

In one example, the drying of the object may always involve insufficient drying and excessive drying. Therefore, it is very important that the drying be carried out such that the object has a desired moisture content. For this reason, it is very important to determine a drying ending timing when the apparatus stops heating of the object and ends the drying process.

The conventional dryer or drying and washing machine as described above has an air circulation structure. Therefore, a conventional drying ending timing determination logic or sensor used in the conventional dryer or drying and washing machine may not be suitable for the present apparatus.

For this reason, the present embodiment may provide a novel drying ending timing determination logic or sensor other than the conventional drying ending timing determination logic or sensor used in the conventional dryer or drying and washing machine.

As described above with reference to FIG. 2, the laundry treating apparatus according to the present embodiment may include the two temperature sensors 95 and 96. One temperature sensor 95 may be a temperature sensor for sensing a temperature of the washing-water and may be mounted to an inner bottom face of the tub.

The controller or the processor 9 controls the heating of the washing-water and the operation of the induction heater when washing the object, based on a temperature detected by the temperature sensor 95. In one example, when a heating target temperature of washing-water is 60 degrees Celsius, the processor 9 heats the washing-water via the operation of induction heater until the temperature of washing-water detected by the temperature sensor 95 reaches 60 degrees Celsius.

Because washing-water is water, the water may not be heated to a temperature above 100° C. in a normal condition or environment. However, because the drum is made of metal and heated directly by an induction heater, the drum may be easily heated up to 160 degrees Celsius in a very short time.

Accordingly, in order to prevent overheating of the drum and/or to control the temperature of the air in the tub, the temperature sensor 96 may be additionally disposed separately from the washing-water temperature sensor 95.

The temperature sensor 96 is configured to be in non-contact with the washing-water. Thus, the sensor 96 may be referred to as a drying temperature sensor 96. A location of the drying temperature sensor 96 is very important because the air temperature inside the tub must be optimally sensed and a temperature of the rotating drum may be estimated effectively.

Hereinafter, a mounting position of the drying temperature sensor 96 will be described in detail with reference to FIGS. 4 to 5.

Figure 4:
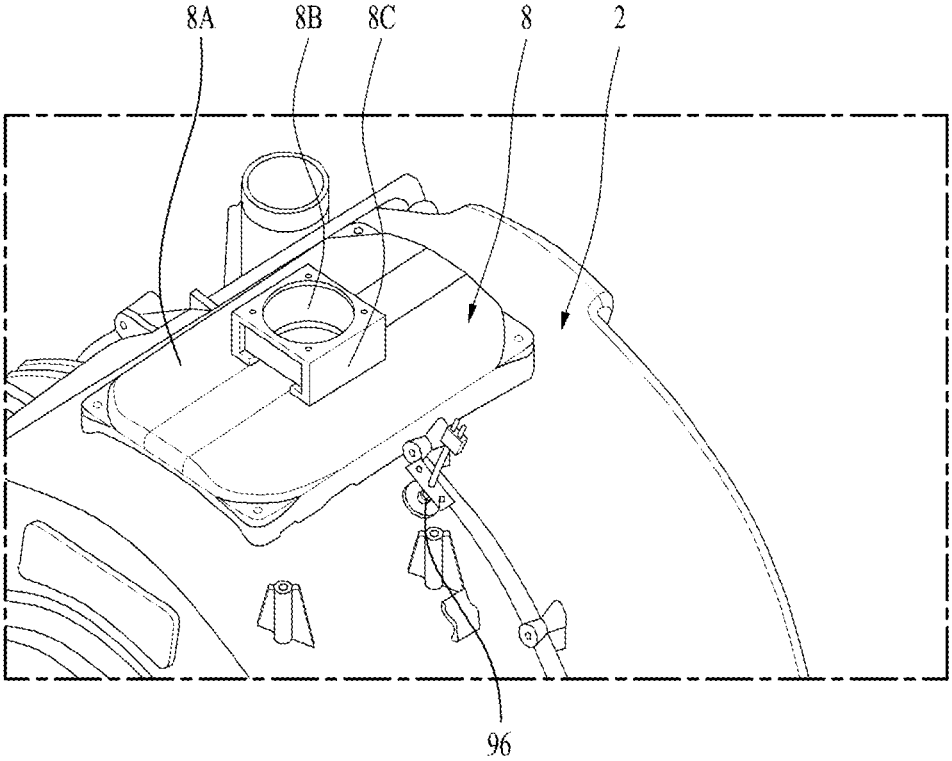
FIG. 4 shows an example in which an induction heater and an upper temperature sensor are mounted on a tub in a laundry treating apparatus according to one embodiment of the present disclosure.
Figure 5:
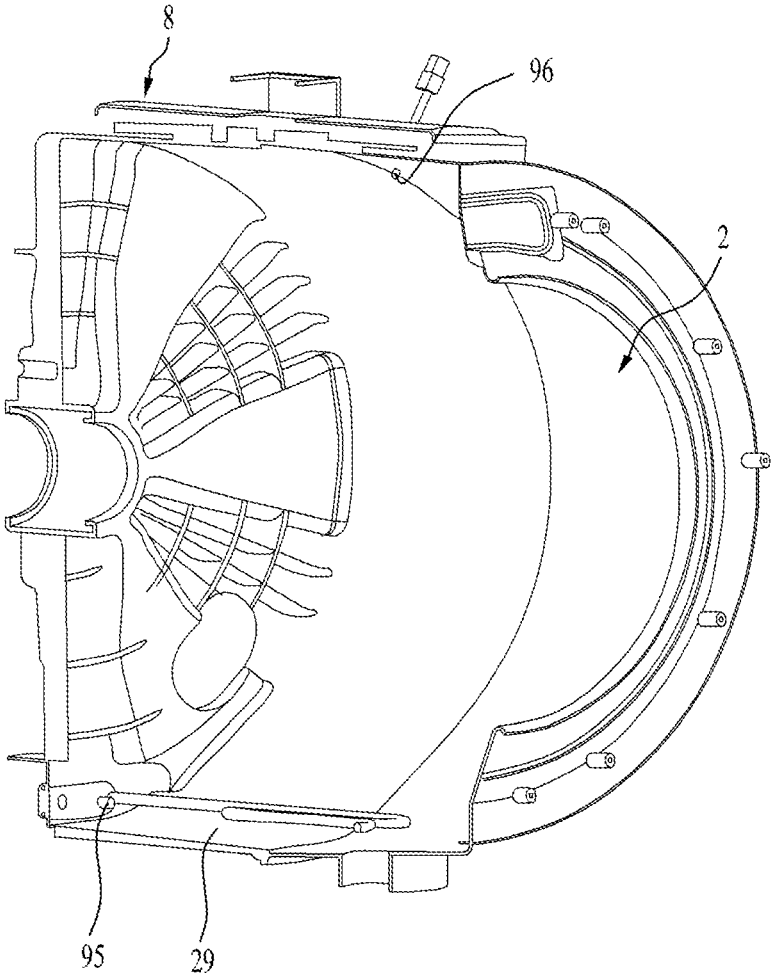
FIG. 5 shows a state in which upper and lower temperature sensors are mounted so as to protrude into a tub.

As shown in FIG. 4 to FIG. 5, the induction heater 8 may be mounted on a top face of the tub. That is, the induction heater 8 may be mounted on a top outer circumferential face of the tub. Due to the mounting position of the induction heater 8, a top outer circumferential face of the drum may be heated by the induction heater 8.

The location of the induction heater 8 is set to prevent overheating of the object effectively because the object inside the drum is not in contact with the top portion of the drum while the drum is stopped. Therefore, the induction heater 8 may be controlled to operate as the drum rotates. This may evenly heat the object.

In this connection, a location of the drying temperature sensor 96 may be very important. This is because it is necessary to measure the temperature of the drum due to heating and to measure the air temperature inside the tub.

Preferably, the drying temperature sensor 96 may be mounted immediately below the induction heater 8 to sense the air temperature at the outer circumferential face of the drum having the highest temperature. However, a very large magnetic field change occurs to induction-heat the drum in a region immediately below the induction heater 8. This change in the magnetic field may affect the drying temperature sensor 96 which has a small current magnitude.

Therefore, the drying temperature sensor 96 may be preferably mounted adjacent to one side of the induction heater 8 and may be mounted at a position outside a vertical projection face of the induction heater 8.

When viewed from a front of the tub, the drying temperature sensor 96 may be mounted adjacent to the left or right side of the induction heater 8.

In this connection, the tub inner-space may not be a completely sealed space. That is, a communication hole 28 that communicate the tub inner-space with the outside of the tub may be formed in the tub. This may be intended to prevent a safety accident in which an animal or child enters and is trapped in the tub from occurring when the space inside the tub is completely sealed and the door is closed.

When the communication hole 28 is mounted adjacent to the left side of the tub when the tub is viewed from the front of the tub, the drying temperature sensor 96 is preferably mounted adjacent to on the right side of the tub. When the communication hole 28 is mounted adjacent to the right side of the tub when the tub is viewed from the front of the tub, the drying temperature sensor 96 is preferably mounted adjacent to on the left side of the tub. This is because a temperature near the communication hole 28 may be affected by air outside the tub having a relatively low temperature.

The drying temperature sensor 96 may be mounted to pass through the tub from the outside of the tub. Thus, a signal line or an electrical wire of the drying temperature sensor 96 may be placed outside the tub. A sensing element of the sensor may partially protrude radially from an inner circumferential face of the tub.

Thus, the drying temperature sensor 96 directly senses a temperature of air in a space between the outer circumferential face of the drum and the inner circumferential face of the tub. The sensed temperature may be used to indirectly and experimentally determine or estimate a temperature of the outer circumferential face of the drum.

An operation of the induction heater 8 may be controlled based on the temperature detected by the drying temperature sensor 96. That is, the drying temperature sensor 96 may be used to prevent overheating of the drum and overheating of the temperature inside the tub.

The induction heater 8 may be operated to achieve a heating target temperature. In one example, the heating target temperature may be set to about 95 to 99 degrees Celsius. That is, the induction heater may be operated until the drying temperature sensor 96 detects the heating target temperature. The operation of the induction heater 8 may be stopped when the heating target temperature is detected by the sensor 96. When the temperature decreases, the operation of the induction heater is started again. An on/off control of the induction heater may be performed when the detected temperature is near the heating target temperature.

In this connection, the heating target temperature is preferably not set to a temperature above 100 degrees Celsius. This is because when the temperature of the air is detected as a temperature above 100 degrees Celsius, the air is not in a humid steam states but in an overheated steam state. That is, an amount of heat used to convert the humid steam to overheated steam larger than an amount of heat used to evaporate moisture may be consumed. This lead to waste of energy. Further, overheated steam occurrence means that the drum is heated to about 160 degrees Celsius or higher. This may mean the drum overheating. This may cause thermal deformation or thermal damage of the tub made of plastic. For this reason, the washing-water is only heated up to a temperature lower than 100° C. in the laundry treating apparatus.

During drying, heating the drum should be configured to allow a maximum heat amount to be supplied in a minimum time duration in a safe range. Thus, as drying is performed, the temperature detected by the drying temperature sensor 96 converges to the heating target temperature. That is, the temperature detected by the drying temperature sensor 96 gradually increases from room temperature and converges to the heating target temperature. In another example, since the temperature detected by the drying temperature sensor 96 reaches the heating target temperature for the first time, the temperature detected by the sensor 96 may vary in a range between the heating target temperature and an induction heater re-operation temperature via an off/on repetition of the induction heater. The induction heater re-operation temperature may be set to a temperature lower by about 2 to 3 degrees Celsius than the heating target temperature. However, the present disclosure is not limited thereto.

As a result, the temperature detected by the drying temperature sensor does not exceed the heating target temperature. This is because the heating is stopped before the temperature detected by the drying temperature sensor exceeds the heating target temperature.

Using basic functions and characteristics of the drying temperature sensor, dryness or humidity detection may be performed as described below. The apparatus may determine the drying ending timing based on the dryness or humidity detection result.

Hereinafter, a mounting position of the washing-water temperature sensor 95 will be described in detail with reference to FIGS. 5 to 6.

The washing-water temperature sensor 95 may be mounted at a lower portion of the tub because the sensor 95 is configured to detect the temperature of the washing-water. Therefore, the mounting position of the washing-water temperature sensor 95 may be the same as that in a general laundry treating apparatus. That is, the washing-water temperature sensor 95 may be disposed at a lower portion of the tub and inside the tub so as to be immersed in the washing-water to detect the temperature of the washing-water. The washing-water temperature sensor 95 may be disposed to be spaced upwardly from an inner bottom surface of the tub. The washing-water temperature sensor 95 may located below the bottom of the drum.

In this connection, the drying temperature sensor 96 may be located on the top inner face of the tub and the washing-water temperature sensor 95 may be located at the lower portion of the tub and in the tub. Therefore, the drying temperature sensor 96 may be referred to as an upper temperature sensor, while the washing-water temperature sensor 95 may be referred to as a lower temperature sensor.

Further, the drying temperature sensor 96 and washing-water temperature sensor 95 detect the temperatures of air and washing-water, respectively. Based on the detected temperatures, the processor may control the operation of the induction heater. Thus, each of the drying temperature sensor and washing-water temperature sensor may be embodied as a thermistor that may detect a temperature linearly or in a stepwise manner.

A conventional sheath heater passes through a rear or front wall of the tub and is mounted at a lower portion of the tub. This mounting structure and sealing structure of the sheath heater may be used to mount the washing-water temperature sensor 95 on the tub. In another example, although not preferred, the induction heater may be operated for drying and the sheath heater may be operated for washing-water heating. However, as described above, the sheath heater may be omitted. Rather, the washing-water temperature sensor may be mounted using the mounting structure and the sealing structure of the sheath heater, thereby to minimize deformation of the conventional tub or deformation of devices around the tub. This means that increase in initial facility investment or increase in mold investment may be minimized. This is because only a small modification to the conventional facility or mold is required.

Figure 6:
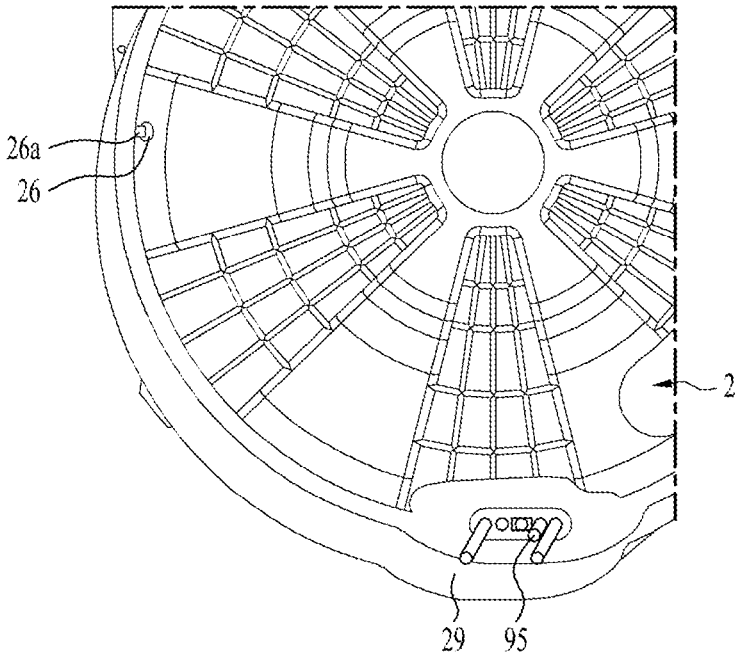
FIG. 6 shows a state in which a lower temperature sensor is mounted inside a tub and a location of a cooling water port.

As shown in FIG. 5 to FIG. 6, it is preferable to form a condensed water receiving portion 29 as recessed downwards in an inner bottom portion of the tub. Condensed water is produced as the hot humid steam contacts an inner face of the tub and thus cools down. This condensed water flows along the inner surface of the tub and accumulates in the condensed water receiving portion 29 which is formed in the inner bottom portion of the tub.

The condensed water receiving portion 29 may be formed at a rear side of the tub to facilitate discharge of the condensed water. The condensed water receiving portion 29 may store washing-water therein when washing the object. A bottom of the condensed water receiving portion 29 may be connected to the discharge pump to drain substantially an entirety of the washing-water in the tub during drainage.

In this connection, the washing-water temperature sensor 95 is preferably located above the condensed water receiving portion 29. Specifically, the sensor 95 may pass through a rear wall of the tub in a front direction and may be spaced from a bottom surface of the condensed water receiving portion 29.

An amount of the condensed water contained inside the tub is not large. During drying, the condensed water is not stored inside the tub continuously and is drained intermittently or periodically out of the tub. Therefore, a maximum level of the condensed water during drying is relatively low. This means that the washing-water temperature sensor 95 senses air temperature around the condensed water instead of directly sensing a temperature of the condensed water during drying.

In other words, when drying the object, the drying temperature sensor 96 senses a temperature of humid air or dry air having the highest temperature at the highest position, while the washing-water temperature sensor 95 senses a temperature of humid air or dry air having the lowest temperature at the lowest position.

The temperature of the condensed water may vary during the drying process. That is, the sensed temperature of the condensed water may vary depending on a position of the tub at which the condensed water is introduced into the tub. This variation causes a decrease in reliability of a temperature of the condensed water itself during drying. However, the temperature of the air adjacent the condensed water may be reliable. It is because natural convection occurs, and, thus, a change in the air temperature at the bottom of the tub is very small.

Therefore, the washing-water temperature sensor 95 in the present embodiment is preferably mounted to be spaced upwards from the inner bottom surface of the tub, as shown in FIG. 5 to FIG. 6. When considering the amount of the condensed water, the washing-water temperature sensor 95 may preferably be spaced, by approximately 10 mm to 15 mm, from the bottom face of the condensed water receiving portion.

The present applicant has disclosed a laundry treating apparatus to which an induction heater is applied (refer to a Korean patent application No. 10-2017-0101333, hereinafter, "prior application"). Accordingly, a disclosure set forth in the prior application may apply equally to one embodiment of the present disclosure, unless being contradictory to the present disclosure or being exclusive. In particular, an induction heater structure, a mounting structure, and a cooling water supply structure set forth in the prior application may be equally applicable to one embodiment of the present disclosure.

In one example, the housing 8A of the induction heater 8, the fan casing 8C formed on the housing, the fan mount 8B formed on the fan casing 8C, and the fan as shown in FIG. 4 may be the same as those in the prior application. The coil may be placed inside the induction heater housing 8A.

In particular, as shown in FIG. 6, a cooling water port 26 may be disposed on a rear wall of the tub 2. The cooling water port 26 allows the room temperature water to flow forward and downward along and on the inner circumferential surface of the tub.

At an outlet portion of the cooling water port 26, a rib 26*a* extending forwardly in an elongate manner may be formed. Water discharged through the cooling water port 26 flows downs along the rib 26*a* and thus descends. Thus, the cooling water flows downwards. This may increase a contact area between the cooling water and the inner circumferential face of the tub.

Discharge of the cooling water through the cooling water port 26 may be performed to lower the air temperature inside the tub after dehydration based on heating or after drying. This is because when the air inside the tub is too high when the user opens the door, a safety accident may occur or the user may be uncomfortable.

In one example, the discharge of the cooling water may be carried out during drying. This is because the cooling water flows along the inner circumferential face of the tub to further promote moisture condensing in humid steam. This cooling water flows to a bottom of the tub together with the condensed water produced by condensing the moisture in humid air.

As described above, the cooling water flows in a thinly widely spread state on and along the inner circumferential face of the tub, this may significantly increase a heat transfer area. That is, effective moisture condensing may occur using a small amount of cooling water.

As described above, in the present embodiment, the apparatus includes the upper temperature sensor 96 for sensing a drum temperature or an air temperature around the drum and the lower temperature sensor 95 for sensing a temperature of the washing-water. The operation of the induction heater may be controlled based on the detected values from these temperature sensors. In addition, as described above, the lower temperature sensor 95 may sense the temperature near the condensed water during drying.

In this embodiment, the dryness or humidity may be determined using the temperature sensors 95 and 96. The dryness or humidity may be used to determine the drying ending timing. In other words, the temperature sensors 95 and 96 may have an auxiliary function to help determine the drying ending timing in addition to respective main functions thereof.

Hereinafter, referring to FIGS. 7 and 8, factors used in determining the drying ending timing using the upper temperature sensor 96 and the lower temperature sensor 95 will be described in detail.

Figure 7:
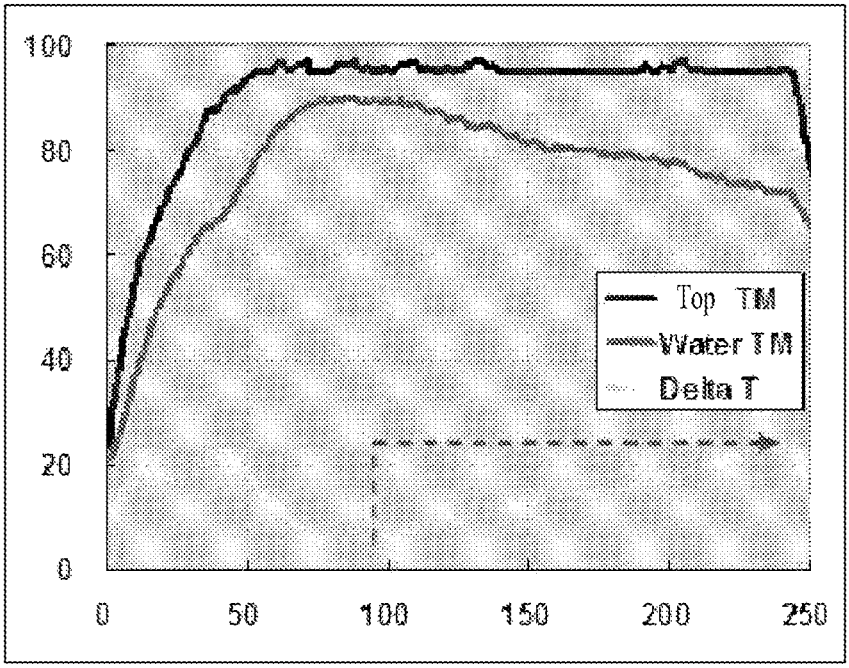
FIG. 7 and FIG. 8 show change in a temperature during a drying process at different drying target load amounts.
Figure 8:
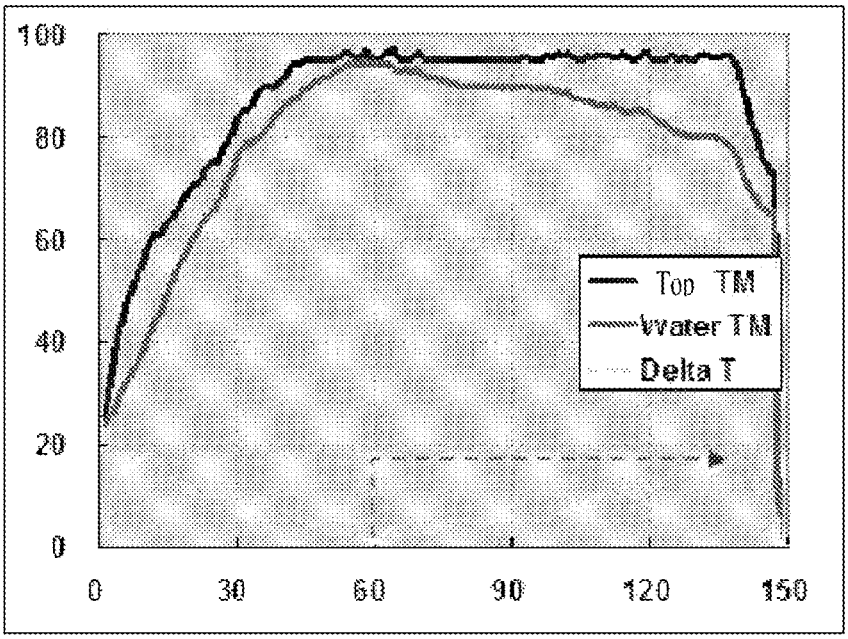

FIG. 7 and FIG. 8 show changes in temperatures detected by the upper and lower temperature sensors 95 and 96 over time and a difference (delta T) between the temperatures.

In one example, FIG. 7 shows a case in which a drying target load amount is 7 kg. FIG. 8 shows a case in which a drying target load amount is 3 kg.

In a drying cycle in which drying of a wet object is performed by heating the drum, the temperature change and temperature difference will vary depending on drying progression timings.

In an initial duration of drying, the object is heated by drum the heating, thereby causing sensible-heat exchange. That is, most of an amount of heat as supplied is used for the sensible-heat exchange. That is, an moisture evaporation amount is very small at this time.

Therefore, from a start of the drying to an end of the initial duration of drying, a temperature of upper air inside the tub gradually increases to reach the heating target temperature. In this connection, a temperature of lower air inside the tub also gradually increases, but an increase rate thereof is relatively small. Thus, the delta T increase rapidly. This is because the upper temperature sensor senses a temperature near a heating source and the lower temperature sensor senses a temperature at a position at a maximum distance from the heating source. Then, as the heating further proceeds, a change in the delta T becomes smaller.

As the drying proceeds further, moisture evaporation occurs and a heat amount for heating the humid steam is the same as or similar to a cooling capacity of the cooling water. Therefore, the change in the temperature detected near the condensed water storage at the bottom of the tub may be very small or the temperature may remain the same. At this time, the delta T is decreased. It is because the temperature detected by the upper temperature sensor converges to the heating target temperature while the temperature detected by the lower temperature sensor converges to the maximum temperature of the condensed water.

As the drying continues, the moisture evaporation may be saturated. That is, the moisture evaporation may be maximized. The delta T may be maintained as it is until this point. That is, the change in the temperature detected by the upper temperature sensor and the change in the temperature detected by the lower temperature sensor may be very small.

After the saturation of the moisture evaporation, the moisture evaporation gradually decreases. Therefore, at this time, the cooling capacity of the cooling water is greater than a heat amount for heating dry air. Because the cooling water itself is water at room temperature as supplied from the outside, the temperature detected by the lower temperature sensor is gradually lowered. In other words, the amount of the condensed water produced using the cooling water decreases because the temperature of condensed water is lowered.

Eventually, when the temperature detected by the lower temperature sensor reaches a certain temperature, the moisture evaporation rarely occurs. In particular, it may be seen that when the temperature detected by the upper temperature sensor is constant as the heating target temperature, the moisture evaporation hardly occurs when the delta T decrease to reach a predetermined value.

Therefore, dryness or humidity may be estimated indirectly and very accurately based on the temperature detected by the lower temperature sensor, the change in the temperature and/or the delta T value and the change in the delta T. This means that the ending timing of heating may be grasped in this manner.

The drying target load amount may be defined as a weight of a load to be dried. It may be assumed that the weight of the load is proportional to an amount of moisture that must evaporate away from the load. When the drying target load amount is large, the heat amount for sensible-heat exchange, that is, preheating is large and thus the heating time duration becomes large. Under assumption that the same amount of heat is supplied per hour, a rate of temperature increase due to heating decreases as the drying target load amount increases.

A rate of the change of the temperature when the drying target load amount is 7 Kg as shown in FIG. 7 may be smaller than a rate of the change of the temperature when the drying target load amount is 3 Kg as shown in FIG. 8. However, it may be seen that Y-axis scales (temperatures) in FIG. 7 and FIG. 8 are the same as each other, but X-axis scales (time durations) in FIG. 7 and FIG. 8 are different from each other. Therefore, it may be seen that the rate of the change of the temperature is greater when the drying target load amount is substantially smaller.

A temperature change and dryness based on the drying target load amount may be obtained experimentally. An experimental result shows that the delta T is larger when the drying target load amount is large under a same dryness condition. In one example, the drying ending timing may be determined when the delta T is 18 degrees Celsius when the drying target load amount is 7 kg. The drying ending timing may be determined when the delta T is 15 degrees Celsius when the drying target load amount is 3 kg. That is, when the delta T values of the former and latter cases are different from each other, the drying may be terminated at the same dryness due to the difference between the drying target load amounts of the former and latter cases.

In one example, an amount of water that the laundry may absorb depends on a laundry material or type. In one example, cotton may absorb a larger amount of water that chemical fiber may absorb. Therefore, a total weight of the object is not necessarily proportional to an amount of water to be removed therefrom. Further, when drying the same laundry, the amount of water to be removed in drying in a fully wet state and the amount of water to be removed in drying in a partially wet state are different from each other.

Therefore, it is desirable that not a weight of an object initially injected to the apparatus but a weight of the object during the drying process may be determined as a drying target load amount. In other words, an amount of moisture to be removed may be determined during the drying process. Thus, the apparatus may determine the drying ending timing based on the determined amount of moisture to be removed during the drying process.

Specifically, as shown in FIG. 7 and FIG. 8, it may be seen that the apparatus may determine the drying target load amount using a difference in the temperature change based on a difference in the drying target load amount.

That is, as the drying target load amount is smaller, a time required for the delta T to reach a maximum value is smaller. Further, it may be seen that the smaller the drying target load amount, the smaller the maximum value of the delta T. Further, it may be seen that the smaller the drying target load amount, the smaller the minimum value of the delta T.

In addition, the delta T increases to the maximum value and then decreases to the minimum value and then gradually increases, regardless of the drying target load amount. This may be appreciated based on a fact that the drum is heated up to the heating target temperature and thus the drying is performed.

In this connection, it may be seen that the maximum value of the delta T is detected before the upper temperature sensor senses the heating target temperature for the first time. Further, it may be seen that the minimum value of the delta T is detected after the heating target temperature is sensed by the upper temperature sensor for the first time. Thus, the drying may basically proceed until the upper temperature sensor senses the heating target temperature for the first time and then the apparatus may determine the drying target load amount based on the delta T. That is, the drying target load amount may be determined based on the maximum value of the delta T as detected before the upper temperature sensor senses the heating target temperature for the first time, or based on the minimum value of the delta T as detected after the heating target temperature is sensed by the upper temperature sensor for the first time, a time required to reach the maximum value of the delta T, or a time required to reach the minimum value of the delta T.

Once the drying target load amount is determined, the apparatus may determine a temperature condition at which the drying stops, depending on the determined load amount. That is, the temperature or delta T value detected by the lower temperature sensor may be determined. In one example, when the drying target load amount of 7 Kg is determined, the delta T may be determined as 18 degrees Celsius. In one example, when the heating target temperature is 98 degrees Celsius and the delta T is 18 degrees Celsius, the temperature detected by the lower temperature sensor may be 80 degrees Celsius. Because the temperature detected by the upper temperature sensor converges to the heating target temperature after the heating target temperature is detected for the first time, the heating target temperature may be a fixed value. Therefore, the drying ending timing may be determined only based on the temperature value detected by the lower temperature sensor without obtaining the delta T as the difference between the temperatures detected by the upper and lower temperature sensors.

In one example, according to FIG. 7 and FIG. 8, an initial drying duration may be defined as a duration from the start of drying to a time when the delta T is the greatest before the upper temperature sensor detects the heating target temperature. An intermediate drying duration may be defined as a duration from an end of the initial drying duration to a time when the delta T is smallest. Finally, a last drying duration may be defined as a duration from an end of the intermediate drying duration to a time when the heating stops depending on the temperature detected by the lower temperature sensor or the delta T.

Drying may end immediately after the last drying duration. When necessary, the apparatus may perform cooling via cooling water supply and drum operation without heating, thereby to terminate the drying.

In order to determine the exact drying target load amount, the drying target load amount may be determined based on data at a previous or subsequent time point to a time when the heating target temperature is detected for the first time. Therefore, a determination time point of the drying target load amount is preferably present after the first heating target temperature is detected for the first time.

In one example, the drying process as described above will be described in association with a control method as follows.

A heating step is performed for drying. The heating step refers to the operation of the induction heater along with the drum operation. The operation of the induction heater may be performed based on the temperature detected by the upper temperature sensor. The apparatus may substantially continue the operation of the induction heater until the heating target temperature is detected. Thereafter, the apparatus may maintain the heating target temperature while repeating an on/off operation of the induction heater. The heating step may be performed continuously from the start to the end of the drying cycle. That is, the heating step may be performed while the apparatus is monitoring the temperature detected by the upper temperature sensor.

A condensing step is performed to remove evaporated moisture. The apparatus may sense the temperature of the condensed water which is condensed within the tub due to the natural convection inside the tub. That is, the condensing step is performed while detecting the temperature using the lower temperature sensor. The condensing step may be performed continuously from the start of the drying cycle to the end thereof. In another example, introduction of the cooling water may be performed intermittently or periodically.

In this connection, during the drying cycle, the heating and condensing steps may be performed in parallel.

When, during the drying cycle, that is, during the heating and condensing steps, the delta T satisfies a predefined specific value or the lower temperature sensor senses a predefined specific value, the heating and condensing steps may be terminated. That is, heating and condensing may be terminated. In this connection, the predefined specific value may be predefined based on the drying target load amount. As the drying target load amount varies, the predefined specific value may change. This has been described above.

Further, a step of determining the drying target load amount may be performed. when the drying target load amount is determined based on only a total weight of the object, the drying target load amount is likely to be incorrectly determined depending on the laundry material or type and a moisture content of the object as initially injected. Therefore, in the present embodiment, after the heating target temperature is detected for the first time, the drying target load amount may be effectively determined based on temperature data. That is, regardless of the laundry material or type and a moisture content of the object as initially injected, the apparatus may accurately determine the load amount associated with the moisture to be removed using drying.

In particular, in the present embodiment, both of the upper temperature sensor for controlling the operation of the induction heater and the lower temperature sensor for adjusting the temperature of the washing-water may be used. Alternatively, the drying ending timing may be determined using only the lower temperature sensor. However, as described above, in order to determine the correct load amount, not only data detected by the lower temperature sensor but also data detected by the upper temperature sensor are required. The delta T data may be derived from both detected data.

Thus, according to this embodiment, the drying ending timing determination may be executed using the two temperature sensors that have basic main functions thereof. Therefore, effects of remarkable manufacturing cost reduction, ease of manufacture, and ease of control may be expected.

Effects as not described herein may be derived from the above configurations. The relationship between the above-described components may allow a new effect not seen in the conventional approach to be derived.

In addition, embodiments shown in the drawings may be modified and implemented in other forms. The modifications should be regarded as falling within a scope of the present disclosure when the modifications is carried out so as to include a component claimed in the claims or within a scope of an equivalent thereto.

What is claimed is:

1. An object treating apparatus comprising:

a tub having a first tub portion and a second tub portion, the second tub portion arranged vertically below the first tub portion;

a drum rotatably disposed within the tub and configured to receive an object therein;

an induction heater disposed on the tub and configured to heat an outer circumferential face of the drum facing the heater;

a motor configured to rotate the drum;

a first temperature sensor configured to detect a temperature of a space between the tub and the drum, the first temperature sensor being disposed inside the tub at the first tub portion;

a second temperature sensor configured to detect a temperature of condensed water at a bottom of the tub, the second temperature sensor being disposed in the second tub portion and inside the tub; and a processor being configured to control a rotation of the drum and further control the induction heater to heat the drum so that the object is dried in the drum, the processor configured to determine a drying time of the object based on a difference between a first temperature detected by the first temperature sensor and a second temperature detected by the second temperature sensor.

2. The object treating apparatus of claim 1, wherein the induction heater is placed on a top of the outer circumferential face of the tub, and wherein the first temperature sensor is located adjacent to the induction heater.

3. The object treating apparatus of claim 2, wherein the first temperature sensor is positioned outside a region in which the induction heater vertically faces toward the drum.

4. The object treating apparatus of claim 3, wherein the first temperature sensor is located at a first side of the first tub portion.

5. The object treating apparatus of claim 4, wherein the tub has a communication hole defined in at a second side of the first tub portion, the second side being opposite to the first side, the communication hole configured to fluidly communicate an inside of the tub with an outside of the tub.

6. The object treating apparatus of claim 4, wherein the object treating apparatus includes a cooling water port provided at a rear face of the tub to supply cooling water to an inner wall of the tub.

7. The object treating apparatus of claim 6, wherein the cooling water port is configured to supply the cooling water to cause the cooling water to flow along a first inner circumferential face of the tub or flow along a second inner circumferential face of the tub, or flow along the first inner circumferential face and the second inner circumferential face of the tub, the second inner circumferential face being opposite to the first circumferential face.

8. The object treating apparatus of claim 1, wherein based on the first temperature sensor detecting a predefined temperature, the processor is configured to stop the induction heater or to lower an output thereof.

9. The object treating apparatus of claim 1, wherein a distance between the first temperature sensor and a front end of the tub is smaller than a distance between the second temperature sensor and the front end of the tub.

10. The object treating apparatus of claim 2, wherein a distance between the first temperature sensor and a front end of the tub is smaller than a distance between the second temperature sensor and the front end of the tub.

11. The object treating apparatus of claim 1, wherein the tub has a condensed water receiving portion having a recess in the bottom of the tub, wherein the condensed water is contained in the condensed water receiving portion.

12. The object treating apparatus of claim 11, wherein the second temperature sensor is spaced away from a bottom surface of the condensed water receiving portion.

13. The object treating apparatus of claim 12, wherein the second temperature sensor passes through a rear wall of the tub.

14. The object treating apparatus of claim 13, wherein the second temperature sensor is spaced at a distance from the bottom surface of the condensed water receiving portion, the distance ranging between 10 mm and 15 mm.

15. The object treating apparatus of claim 1, wherein based on the second temperature sensor detecting that a washing-water temperature reaches a predefined temperature while the inductor heater heats the washing-water to perform a washing cycle, the processor is configured to stop the induction heater or to lower an output of the induction heater.

16. The object treating apparatus of claim 1, wherein the processor is configured to finish the drying of the object based on the difference satisfying a threshold value, the threshold value being greater as a drying target load amount is larger.

17. The object treating apparatus of claim 16, wherein the processor is configured to determine the drying target load amount based on a time at which the difference between the first temperature detected by the first temperature sensor and the second temperature detected by the second temperature sensor is smallest for an initial drying duration.

18. The object treating apparatus of claim 16, wherein the processor is configured to determine the drying target load amount based on the difference being the smallest for an initial drying duration.

19. The object treating apparatus of claim 17, wherein a time at which the drying target load amount is determined occurs after a heating target temperature of the drum is detected by the first temperature sensor.

20. The object treating apparatus of claim 1, wherein each of the first temperature sensor and the second temperature sensor includes a thermistor configured to allow active control of the processor.

21. An object treating apparatus comprising:

a tub having a first tub portion and a second tub portion, the second tub portion being arranged vertically below the first tub portion;

a drum rotatably disposed within the tub and configured to receive an object therein;

an induction heater disposed on the tub and configured to heat an outer circumferential face of the drum facing the heater;

a motor configured to rotate the drum;

a first temperature sensor configured to detect a temperature of a space between the tub and the drum, the first temperature sensor being disposed inside the tub at the first tub portion;

a second temperature sensor configured to detect a temperature of condensed water at a bottom of the tub, the second temperature sensor being disposed in the second tub portion and inside the tub; and a processor configured to control a rotation of the drum and further control the induction heater to heat the drum so that the object is dried in the drum, the processor configured to determine a drying time of the object based on the first temperature sensor detecting a heating target temperature of the drum, and the processor being configured to determine the drying time based on a difference between a highest temperature detected by the second temperature sensor and a temperature subsequently detected by the second temperature sensor.

22. A method for controlling a laundry treating apparatus to dry an object, wherein the apparatus includes a tub, a drum rotatably disposed within the tub and configured to receive the object therein, and an induction heater disposed on the tub and configured to heat an outer circumferential face of the drum facing the heater, the method comprising:

detecting a temperature around a space between the tub and the drum using a first temperature sensor disposed at a first tub portion of the tub and inside the tub;

controlling the induction heater based on the detected temperature;

condensing steam evaporated in heat exchange between the heated drum and the object into condensed water inside the tub, wherein the condensed water flows to a bottom of the tub;

detecting a temperature around the condensed water stored on the bottom of the tub using a second temperature sensor, wherein the second temperature sensor is disposed at a second tub portion of the tub and inside the tub, the second tub portion arranged lower than the first tub portion;

determining a drying ending timing based on a difference between a first temperature detected by the first temperature sensor and a second temperature detected by the second temperature sensor, or a difference between a highest temperature detected by the second temperature sensor and a temperature subsequently detected by the second temperature sensor; and terminating the drying based on the determined drying ending timing.

23. The method of claim 22, wherein detecting a temperature around the space between the tub and the drum and controlling the induction heater are performed in parallel with condensing steam and detecting a temperature around the condensed water.

24. The object treating apparatus of claim 1, wherein steam evaporated in heat exchange between the heated drum and the object is condensed into the condensed water inside the tub and flows to the bottom of the tub.

25. The object treating apparatus of claim 21, wherein steam evaporated in heat exchange between the heated drum and the object is condensed into the condensed water inside the tub and flows to the bottom of the tub.

* * * * *